United States Patent [19]

Anderson

[11] Patent Number: 4,697,629

[45] Date of Patent: Oct. 6, 1987

[54] TILTING DEVICE FOR THE LADDER MEANS OF A VENETIAN BLIND

[75] Inventor: Richard N. Anderson, Owensboro, Ky.

[73] Assignee: Hunter Douglas Inc., Totowa, N.J.

[21] Appl. No.: 654,924

[22] Filed: Sep. 27, 1984

[51] Int. Cl.[4] ..... E06B 9/32

[52] U.S. Cl. ..... 160/177

[58] Field of Search ..... 160/174, 178 R, 166 R, 160/167, 168, 177, 176

[56] References Cited

U.S. PATENT DOCUMENTS

| | | | |
|---|---|---|---|
| 2,072,464 | 3/1937 | Nisenson | 160/177 |
| 2,112,262 | 3/1938 | Barlou | 160/176 |
| 2,495,888 | 1/1950 | Burns | 160/178 R |
| 2,555,393 | 6/1951 | Burns | 160/177 |
| 3,269,453 | 8/1966 | Vecchiarelli | 160/176 |
| 3,828,838 | 8/1974 | Anderele | 160/176 |
| 3,921,695 | 11/1975 | Debs | 160/176 R |
| 4,143,699 | 3/1979 | Marotto | 160/176 R |
| 4,457,351 | 7/1984 | Anderson | 160/178 R |
| 4,484,612 | 11/1984 | Vecchiarelli | 160/177 |
| 4,494,593 | 1/1985 | Fielder | 160/177 |

FOREIGN PATENT DOCUMENTS

| | | | |
|---|---|---|---|
| 158259 | 3/1957 | Denmark | 160/177 |
| 2805469 | 8/1978 | Fed. Rep. of Germany | 160/177 |

*Primary Examiner*—Reinaldo P. Machado
*Assistant Examiner*—Alvin Chin-Shue
*Attorney, Agent, or Firm*—Pennie & Edmonds

[57] ABSTRACT

A tilting device for the ladder means of a venetian blind. The device comprises a central body member having two symetrically diametrically opposed arms. Each arm includes a cable receiving means adapted to secure an end of a cable thereto where the cable extends over an edge of the opposite arm. Both arms extend in a horizontal direction when the slats of the blind are in the fully open position. Stop means may be provided on the arms to limit rotation about the tilt rod axis.

5 Claims, 8 Drawing Figures

FIG. 5
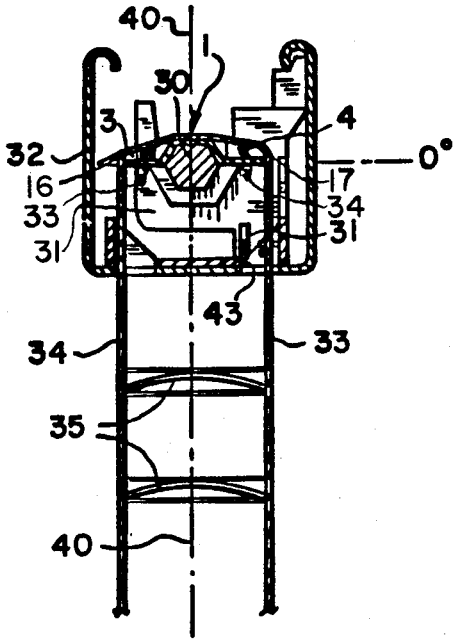
FIG. 6
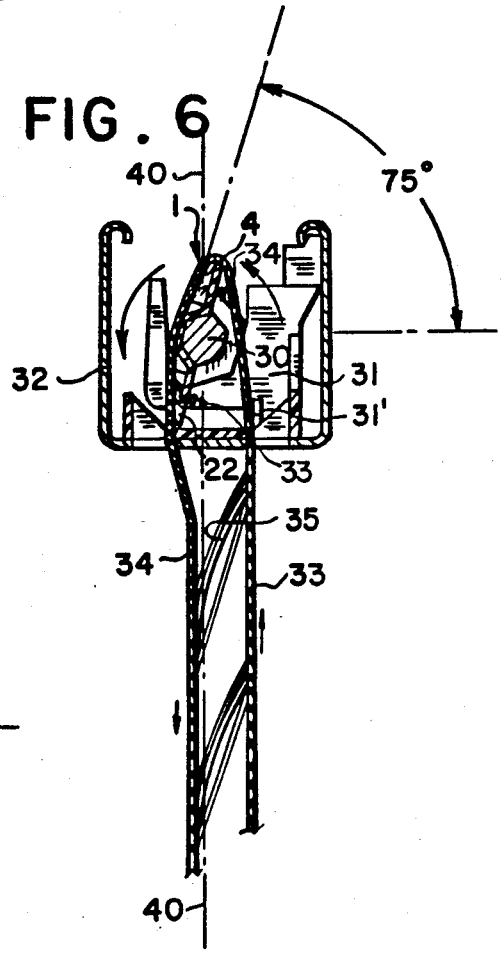
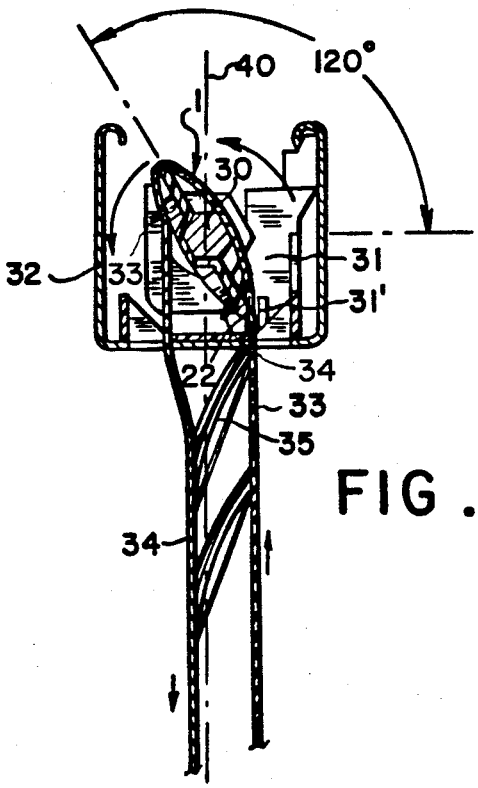
FIG. 7

TILTING DEVICE FOR THE LADDER MEANS OF A VENETIAN BLIND

FIELD OF INVENTION

This invention relates to a tilting device for the ladder means of a venetian blind and more particularly to a tilting device which will impart nonuniform linear movement to tape cables of a ladder means of a venetian blind upon uniform rotation of a tilt rod whereby rate of closure of the slats of the blind will become progressively less as the slats are moved from a fully opened position towards a closed position.

BACKGROUND OF THE INVENTION

A problem existing with conventional venetian blinds, and in particular with venetian blinds of small size, is that the blinds may be easily damaged if the slats are quickly tilted to their fully closed position or if the tilting mechanism for tilting the slats is tilted or moved beyond a position where the slats are fully closed. Some blind assemblies include structure by which the rate of tilt of the slats and linear movement of tape cables forming part of tape ladders is slowed as the slats approach a fully closed position even though a tilt rod activating the tilt mechanism is rotated at a uniform rate. The purpose of this structure is to prevent jarring of the slats and strain on the tape cable that might occur if the slats are rapidly tilted to the fully closed position. A problem with this existing structure is that if over tilting occurs, that is a tilt rod is rotated beyond a point where the slats are in the fully closed position, the rate of tilting and consequently linear movement of tape cables immediately jumps back to a higher rate imparting a strain on the tape cables which in some instances can result in a cable breaking.

It is therefore an object of my invention to provide for a tilting device which will impart a progressively slower rate of tilt to tiltable slats as they are moved from a fully opened position towards a closed position and which at the same time will maintain a slower rate of linear movement of the tapes cables supporting the slats even when the tilt rod is rotated beyond a slat fully closed position.

It is a further object of my invention to provide for means for preventing excessive rotational movement of the tilting device beyond that necessary to fully tilt the slats to a closed position thus preventing damage to the tilting mechanism and to prevent upper slats from being jammed into contact with headrail structures supporting a tilt rod.

GENERAL DESCRIPTION OF THE INVENTION

Broadly a tilting device according to my invention is adapted for use in a venetian blind assembly having a plurality of slats and where the slats are tiltably supported by tape ladders. The ladders themselves include spaced taped cables which, when the slats are in a fully open position, hang in vertical planes with an upper end of the cables being received by the tilting device which in turn is adapted to be mounted on a conventional tilt rod.

The device itself comprises a central body member having two diametrically opposed arms with the arms adapted to extend in a horizontal plane when the slats are in the fully opened position. Each arm has a cable receiving means on a portion thereof spaced from the central body member so that the cable receiving means are symetrically spaced with respect to a central vertical plane passing through the longitudinal axis of the tilt rod and so that a cable the end of which is received by one arm forces over the edge of the opposite arm. The result of this structure is that when the tilt rod is rotated at a uniform rate from a slat fully open position towards a closed position, the tilt cables will be moved in linear directions in the vertical planes at a progressively slower rate and the cables will move towards each other until the lifting cable (the cable moving upwardly) contacts the periphery of the tilt rod. At this point, the slats of the blind are fully closed and linear movement of the tape cables is at its slowest rate. Further rotation of the tilt rod will result in the lifting cable being wrapped around a portion of the tilt rod and moving at the constant slow rate. The operator of the tilt mechanism will at this point usually tire from continuing to twist the tilt mechanism and stop further twisting of the tilt rod since the slats are closed.

However, if for some reason the operator continues to twist the tilt rod, the top slat of the blind assembly would be lifted aainst a headrail suporting the tilt rod preventing further upward movement of the lifting cable and possibly breaking of the lifting cable due to excesive tilt force applied to the tilt rod. For this reason, the device preferably includes a stop on the end of each arm which is adapted to engage a shoulder carried by a tilt rod support mounted at the headrail. The stop is so dimensioned that rotation of the tilt rod will be stopped prior to the top slat engaging the headrail

DESCRIPTION OF THE DRAWINGS

FIG. 5 is a schematic view of the tilting device of FIG. 1 mounted on a tilt rod with the slats of a venetian blind in a fully closed position;

FIG. 6 is a view similar to FIG. 5 showing the slats in a fully closed position;

FIG. 7 is a view similar to FIG. 5 showing the slats in a fully closed position and with the tilt rod rotated beyond the fully closed position; and, FIG. 8 is an enlarged perspective view of a tilt rod suport having a shoulder thereon adapted to contact a stop carried on the tilting device of FIG. 1.

DESCRIPTION OF THE PREFERRED EMBODIMENT

Referring to FIGS. 1–4, there is illustrated a tilting device 1 constructed according to the invention having a central body member 2 and two oppositely disposed arms 3 and 4 which are adapted to extend perpendicular to a tilt rod, not shown, in turn adapted to pass through hex connections 10 and 11 of the device.

Figure 4:
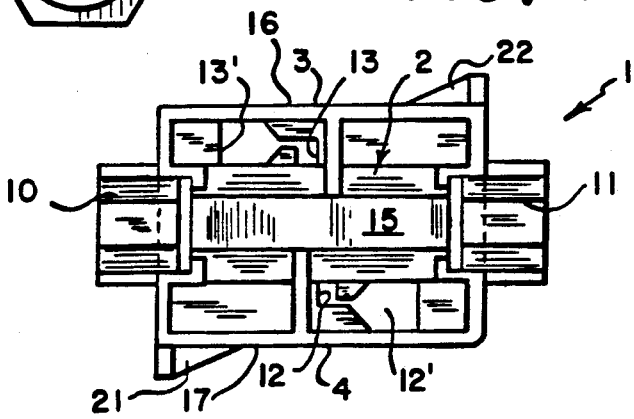
FIG. 4 is a plan view of the tilting device of FIG. 2.

Each arm 3 and 4 has a cable securing means 12 and 13 therein through which an end of a tape cable, not shown, is adapted to pass such that a cable passing through the receiving means 12 as shown in FIG. 4 would extend over a closed portion 15 of the body member and over an edge 16 of the opposite arm 3. The cable receiving means 13 in arm 4 likewise is adapted to have an end of a cable, not shown, extend therethrough, and pass over the edge 17 of the opposite arm 4.

Both cable receiving means 12 and 13 have associated therewith a knot passage hole 12' and 13' through which an enlarged knotted end of a cable may be passed after which the cable is slid through a slot into the securing means.

Figure 1:
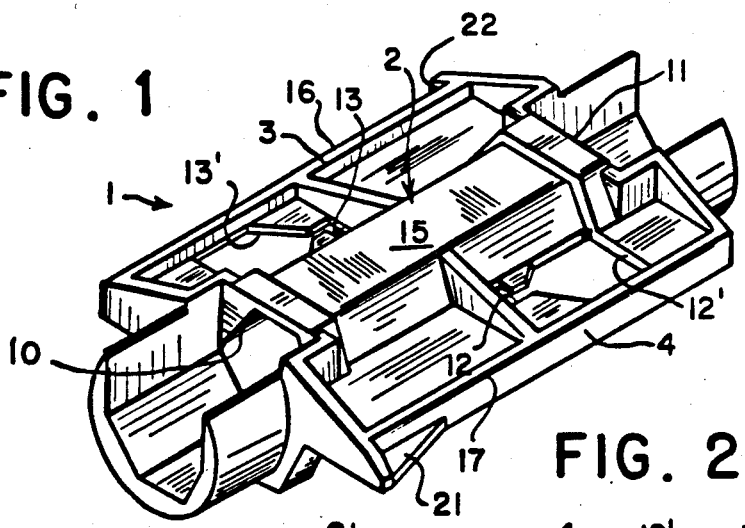
FIG. 1 is a perspective view of a tilting device constructed according to the invention.
Figure 2:
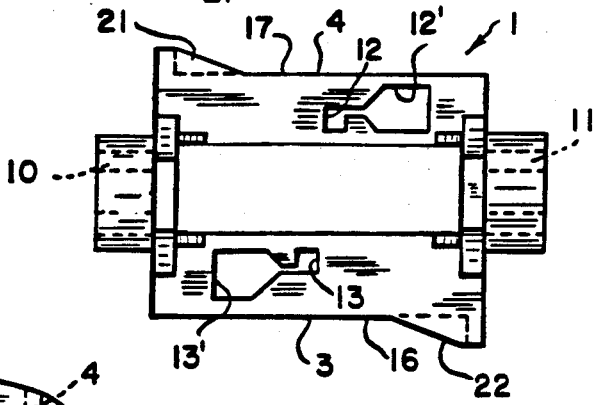
FIG. 2 is a reduced bottom view of the tilting device of FIG. 1.
Figure 3:
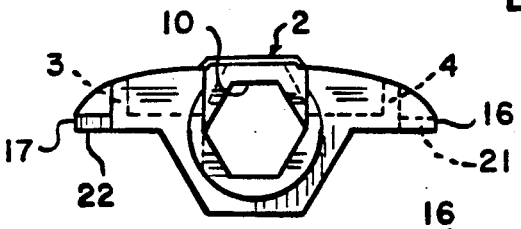
FIG. 3 is an end view of the tilting device of FIG. 2.

The central member 15 as shown in FIG. 2 has an open portion extending between the arms 3 and 4 and adapted to extend over a portion of a tilt rod 30 in order that, as more fully explained hereafter, the cable may contact the exposed portion of the tilt rod upon tilting of the rod to a position beyond the slat fully closed position.

Each arm 3 and 4 has a stop 21 and 22 on the end thereof to limit rotation of the tilt rod as explained more fully hereafter.

Referring to FIGS. 5–7, there is illustrated a typical venetian blind construction having the tilting device according to the invention. As shown, the device 1 is mounted onto a tilt rod 30 which is rotatably supported by a tilt rod support means 31 within a headrail 32. The tilting device has the tape cables 33 and 34 of a ladder means converted thereto and where the ladder means including the cable means 33 and 34 tiltably supports a plurality of slats 35. As shown in FIG. 5, where the slats are in a fully open position, the arms 3 and 4 of the device 1 extend in a horizontal plane with the cables 33 and 34 extending over the edges of the arms 3 and 4.

Referring to FIG. 6, the tilt rod is shown as being rotated 75° to cause the cable 33 to move lineraly upwardly and the cable 34 to move linearly downwardly resulting in tilting of the slats towards a fully closed position. As is apparent from comparing FIGS. 5 and 6, the edges 16 and 17 of the arms, and thus the cables passing over the edges, move towards a central plane 40 passing through longitudinal axis of the tilt rod. This results in the linear upward movement of the cable 33 as well as the linear downward movement of cable 34 being nonuniform and with the rate of movement progressively slowing from the fully slat open position as shown in FIG. 5 towards the slat closed position as shown in FIG. 6.

At the position shown in FIG. 6, or shortly thereafter, the cable 33 contacts the outer periphery of the tilt rod 30 through the open portion of the device such that the cable cannot move closer to the central plane. The rate of linear movement of the tape cables remains constant at this point and throughout further rotation of the tilt rod as shown in FIG. 7.

Stop 22 on arm 3 as shown in FIG. 7 contacts shoulder 31' on the tilt rod support means 31 to stop rotation of the tilt rod before edge 17 of arm 3 engages the cable 33 and before the uppermost slat of the plurality of slats 35 is lifted into engagement with the underside of the headrail. In this manner, damage that might occur to the cable 33 due to acceleration of the linear movement of the cable due to any engagement with the edge of arm 3 is prevented as well as any damage to the upper slat or cable 33 as might occur if the slat were to engage the headrail.

Figure 8:
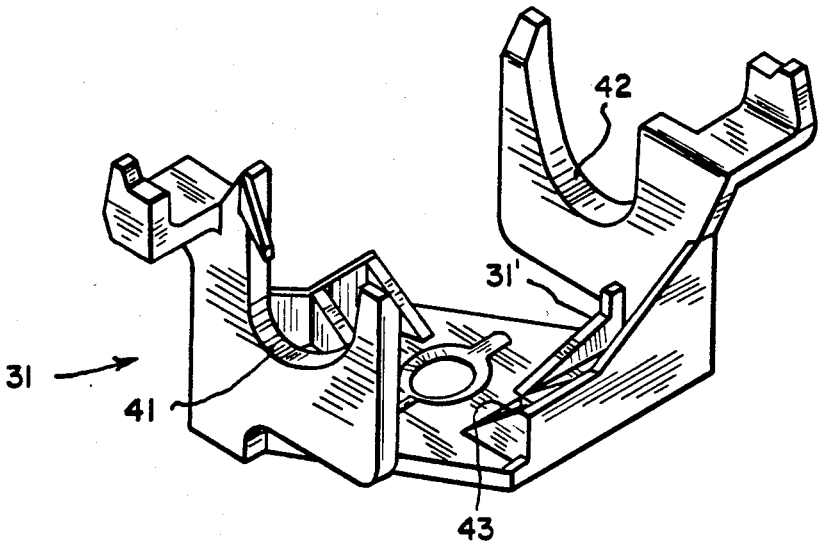

Referring to FIG. 8 there is illustrated a conventional tilt rod support means 31 which includes journal means 41 and 42 for suporting a tilt rod, not shown. The suport means includes rout holes 43, only one of which is shown, through which a tape cable passes and a shoulder 31', only one of which is shown, adapted to engage stop 22 on the tilting device.

The configuration of the tilting device lends itself to be easily made from plastic casting and to be used with venetian blind assemblies of miniature size.

A tilting device as described gives fastest reaction in relation to tilt rod action in the center of the tilting cycle and results in the ability to accomplish full tilt cycle from closure to closure not only with a minimum of turns of a tilt rod, but also with system being under a minimum load or balanced condition. Further, the actual lifting of the blinds that takes place due to the linear upward movement of a lifting cable takes place at the slowest rate of lifting under the highest mechanical advantage.

I claim:

1. A tilting device for a ladder means of a venetian blind where said ladder means comprises a pair of spaced tape cables tiltably supporting slats of the blind therebetween wherein said slats have a predetermined width and wherein said device is adapted to be mounted on a tilt rod having a generally circular cross-sectional shape of predetermined diameter smaller than the width of said slats for oscillatory movement about the longitudinal axis of the rod, characterized in that said device comprises a longitudinally extending central body member through which said tilt rod extends longitudinally, said body member having two symmetrical diametrically opposed arms extending radially outwardly beyond said predetermined diameter in a direction perpendicular to the longitudinal axis of the tilt rod and having outer edges extending parallel to said axis and spaced from each other by a distance substantially equal to the width of said slats, a first cable receiving means in one arm adapted to receive and secure the end of a first tape cable passing over the tilt rod and over the edge of the other arm, a second cable receiving means in the other arm at a position immediately adjacent said first cable receiving means as measured longitudinally along said central body, said second cable receiving means being adapted to receive and secure the end of a second tape cable passing over the tilt rod and over the edge of the one arm, and with the cables passing over the edges of the arms being symmetrically spaced with respect to the longitudinal axis of the tilt rod and hanging vertically in planes equidistant from a central vertical plane passing through said longitudinal axis when the slats are in a fully opened position with the slats and arms extending horizontally whereby when said device is rotated at a uniform rate by the tilt rod to raise one arm and lower the other, the cables move with a generally progressively slower rate of linear movement in their vertical planes, one upwardly and one downwardly, and the cables in their vertical planes move along a horizontal direction toward the central plane to tilt the slats toward a closed position until the slats are fully closed and the edges of both arms are disposed radially inwardly of the predetermined diameter of the tilt rod as measured along said horizontal direction, and whereby further rotation of the tilt rod beyond the point where the slats are fully closed causes the cable which is moving upwardly to wrap around the tilt rod to stop further movement of said upwardly moving cable toward said central plane and to move said cable at a slower constant rate of linear vertical movement.

2. A tilting device according to claim 1 wherein each said arm has a stop on an end thereof adapted to engage a portion of a tilt rod support to limit rotary movement of said device in one direction about the longitudinal axis of the tilt rod and to limit linear movement of said cables.

3. A tilting device according to claim 2 wherein said cable receiving means includes a knot passage hole adapted to receive an enlarged knotted end of a tape cable.

4. A tilting device according to claim 1 wherein said central body member has an open portion between said arms and adapted to extend over part of a tilt rod whereby a cable may contact the tilt rod when further rotation of the tilt rod causes a cable to wrap around the rod.

5. A tilting device for a ladder means of a venetian blind where said ladder means comprises a pair of spaced tape cables tiltably supporting slats of the blind therebetween wherein said slats have a predetermined width and wherein said device is adapted to be mounted on a tilt rod of predetermined diameter smaller than the width of said slats for oscillatory movement about the longitudinal axis of the rod, characterized in that said device comprises, in combination with said tilt rod, ladder means and venetian blind, a longitudinally extending central body member through which said tilt rod extends longitudinally, said body member having two symmetrical diametrically opposed arms extending radially outwardly beyond said predetermined diameter in a direction perpendicular to the longitudinal axis of the tilt rod and having outer edges extending parallel to said axis and spaced from each other by a distance substantially equal to the width of said slats, a first cable receiving means in one arm receiving and securing the end of a first tape cable passing over the tilt rod and over the edge of the other arm, a second cable receiving means in the other arm at a position immediately adjacent said first cable receiving means as measured longitudinally along said central body, said second cable receiving means receiving and securing the end of a second tape cable passing over the tilt rod and over the edge of the one arm, and support means for mounting said device with said tilt rod for rotation at a uniform rate from a first position of rotation, with the slats in a fully opened position and with the slats and arms extending horizontally and with the cables passing over the edges of the arms being symmetrically spaced with respect to the longitudinal axis of the tilt rod and hanging vertically in planes equidistant from a central vertical plane passing through said longitudinal axis, toward a second position of rotation to raise one arm and lower the other and move the cables with a generally progressively slower rate of linear movement in their vertical planes, one upwardly and one downwardly, and to move the vertical planes along a horizontal direction toward the central plane to tilt the slats to a closed position as said device rotates to the second position of rotation where the slats are fully closed and the edges of both arms are disposed radially inwardly of the predetermined diameter of the tilt rod as measured along said horizontal direction, said device being further rotatable in said support means past said second position to cause the cable which is moving upwardly to wrap around the tilt rod and to move in a linear vertical direction at a slower constant rate without further movement toward said central plane.

* * * * *